United States Patent [19]

Leichtfried et al.

[11] Patent Number: 4,684,146

[45] Date of Patent: Aug. 4, 1987

[54] HEEL HOLDER

[75] Inventors: Friedrich Leichtfried, Traiskirchen; Hubert Wuerthner, Hainburg; Alois Himmetsberger, Vienna, all of Austria

[73] Assignee: TMC Corporation, Baar, Switzerland

[21] Appl. No.: 810,640

[22] Filed: Dec. 18, 1985

[30] Foreign Application Priority Data

Dec. 19, 1984 [AT] Austria ..... 4018/84

[51] Int. Cl.[4] ..... A63C 9/084

[52] U.S. Cl. ..... 280/626

[58] Field of Search ..... 280/628, 633, 626, 631, 280/634, 632

[56] References Cited

U.S. PATENT DOCUMENTS

| | | | |
|---|---|---|---|
| 3,580,597 | 5/1971 | Beyl | 280/632 |
| 3,773,341 | 11/1973 | Mimeur | 280/632 |
| 4,456,281 | 6/1984 | Nitschko et al. | 280/628 |

FOREIGN PATENT DOCUMENTS

| | | | |
|---|---|---|---|
| 2700834 | 7/1977 | Fed. Rep. of Germany | 280/632 |
| 2607732 | 9/1977 | Fed. Rep. of Germany | 280/632 |
| 3036210 | 4/1981 | Fed. Rep. of Germany | 280/626 |
| 1485708 | 5/1966 | France | 280/626 |

*Primary Examiner*—David M. Mitchell
*Assistant Examiner*—Eric D. Culbreth
*Attorney, Agent, or Firm*—Flynn, Thiel, Boutell, & Tanis

[57] ABSTRACT

A heel holder includes a base plate, a bearing block supported on the base plate, a binding housing pivotally supported on the bearing block, a control lever pivotally supported on the bearing block and engaging a control element on the binding housing, a release spring which biases the control lever, and a two-arm release lever which is pivotally supported on the control lever and has on a load arm a first extension which can engage a projection on the binding housing and a second extension which can serve as a stop for limiting upward swinging of the binding housing. The swivel axle for the release lever extends through two arcuate holes in sidewalls of the bearing block concentric with the pivot axis of the control lever. The release lever carries a first stop which cooperates with a counterstop on one of the binding housing and bearing block to limit the movement of the release lever which effects a release, and carries a second stop which, in an open position of the binding housing, engages the bearing block or a part thereon to limit swinging of the release lever in a direction toward its release position.

6 Claims, 8 Drawing Figures

HEEL HOLDER

FIELD OF THE INVENTION

This invention relates to a heel holder and, more particularly, to a heel holder which includes: a base plate which can be secured on a ski or movably supported on a guide rail secured on the ski; a bearing block which is supported on the base plate and if desired can be swung out laterally relative thereto, the bearing block having in an upper region thereof a swivel axle which pivotally supports a binding housing having down-holding means and a stepping spur and having in a lower region thereof a further swivel axle which pivotally supports a control lever which slidably engages a control element of the binding housing and is biased by a release spring which can be adjusted in its initial tension; and a two-arm release lever which is pivotally supported on the control lever and has on a load arm thereof two extensions, the lower extension being engageable with a projection on the binding housing and the upper extension serving as a stop for limiting upward swinging of the binding housing, wherein the swivel axle for the release lever extends through two arcuate slotted holes which are provided in the sidewalls of the bearing block and have their centerpoints on the centerline of the swivel axle for the control lever.

BACKGROUND OF THE INVENTION

Such a heel holder is not known to Applicants from any published reference, but instead is a heel holder structure previously developed for and within the corporate assignee of the present application. The swivel axle for the release lever in such heel holder, however, was guided in a slotlike hole provided in the control lever so as to extend approximately radially to the swivel axis of the control lever. This heel holder had the disadvantage that, since the stop for the binding housing provided on the release lever also served as the boundary for the upward swinging of the down-holding member, a defined position of the release lever by means of the release spring was not always given. Therefore, it could happen that, when the initial tension of the release spring was adjusted to a low value, the binding housing would respond to an overload on the down-holding member, for example during an impact, by swinging past the provided end position. The release lever would thus be moved in this case reawardly in the longitudinal direction of the ski against the effective force of the weakly adjusted spring through the support region of the down-holding member on the extension, so that the down-holding member was above the extension. The release spring then pressed the release lever forwardly, so that during re-entry the extension was in the way of the down-holding member.

A similar heel holder is disclosed in U.S. Pat. No. 3,773,341. This design has a bearing block, in the upper region of which there is arranged a swivel axle for a binding housing with a down-holding member and a stepping spur. In the lower region of the bearing block there is provided a further swivel axle for a two-part control lever which engages a control element of the binding housing and is biased by a release spring which can be adjusted in its initial tension. The support of the release spring on the control lever occurs by means of a U-shaped spring abutment which has two legs pivotally supported on the two parts of the control lever by means of two semi-axles. The two semi-axles extend through arcuate slotted holes in the sidewalls of the bearing block and carry on their projecting ends the legs of a U-shaped, one-arm release lever which is supported against shoulders of the bearing block.

This design has a main disadvantage the fact that, for opening the heel holder, the skier must bend down, since opening thereof can be effected only by pulling on a rope. Moreover, the release spring, which has one end anchored on the bearing block, is not only compressed during a release, but is also bent, which requires additional effort.

Furthermore, in a heel holder described in German Offenlegungsschrift No. 2 700 834 the binding housing engages a movable piston which is biased by the release spring. Thus, this heel holder is a different type of heel holder than that to which the invention is directed.

The invention has as a purpose to overcome these disadvantages and to provide a heel holder in which the position of the release lever can be fixed reliably in the stepping-in position of the heel holder, even when the initial tension of the release spring is changed at random.

Starting out from a heel holder of the general type to which the invention relates, this purpose is attained inventively by the release lever carrying a first stop which, in cooperation with a counterstop arranged on one of the binding housing and the bearing block, limits a releasing movement of the release lever, and also carrying a second stop which, in the open position of the binding housing, engages the bearing block or a part which is fixedly connected to the bearing block and thus limits swinging movement of the release lever toward its releasing position. Due to the fact that the position of the release lever is determined by two elements, it is assured that, even at differing initial tensions of the release spring, the release lever is fixed reliably in the stepping-in position.

According to a further development of the invention, it has proven advantageous if the first stop of the release lever is constructed as a transverse plane, a line normal to which goes through the bolt which serves as the swivel axle for the release lever, and if the associated counterstop is formed by a shoulder provided on the binding housing. In this manner, the position of the release lever in the longitudinal direction of the ski is determined structurally in a simple manner and the upward swinging capability of the binding housing is defined therewith.

According to a further feature of the invention, downward pivoting of the release lever is limited by the bearing block itself.

According to another feature of the invention, a counterstop is used for simultaneously securing the release lever against rearward movement and downward swinging movement, which illustrates a substantial simplification.

BRIEF DESCRIPTION OF THE DRAWINGS

Embodiments of the subject matter of the invention are illustrated diagrammatically and exemplarily in the drawings, in which.

DETAILED DESCRIPTION

Figure 1:
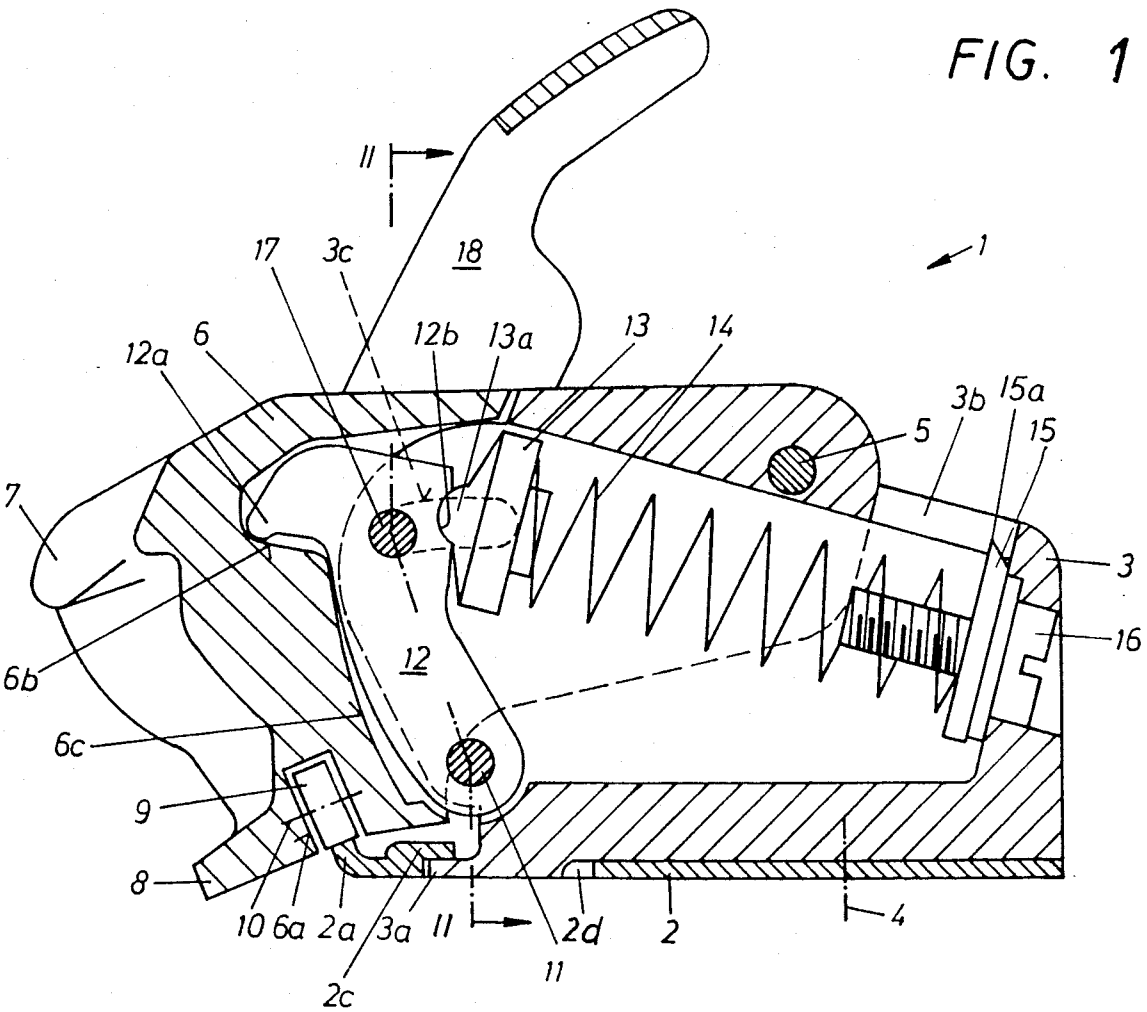
FIG. 1 is a sectional side view taken along the line I—I in FIG. 2 and shows a binding embodying the present invention in a downhill skiing position.
Figure 2:
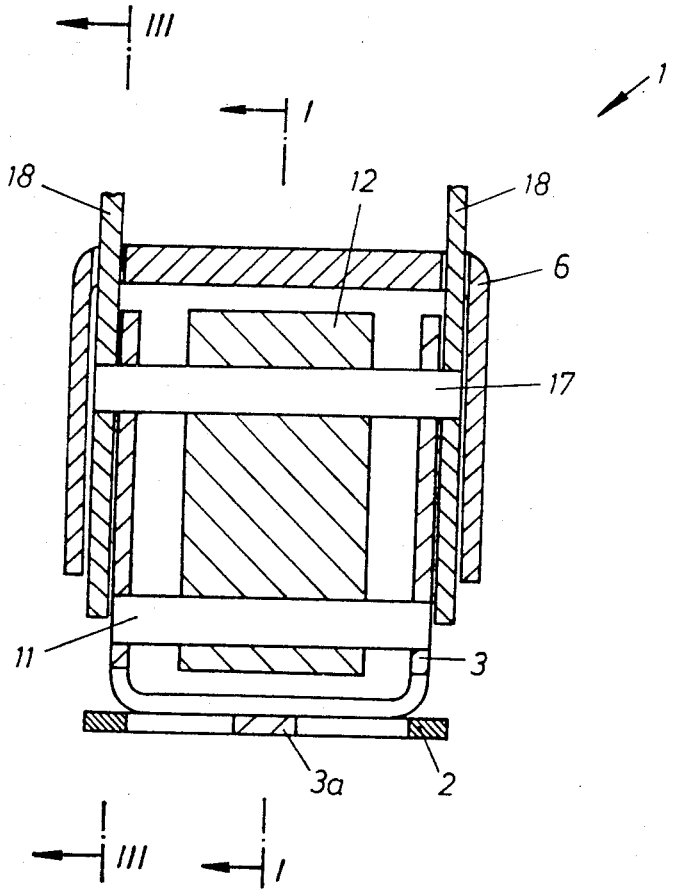
FIG. 2 is a sectional view taken along the line II—II in FIG. 1.
Figure 3:
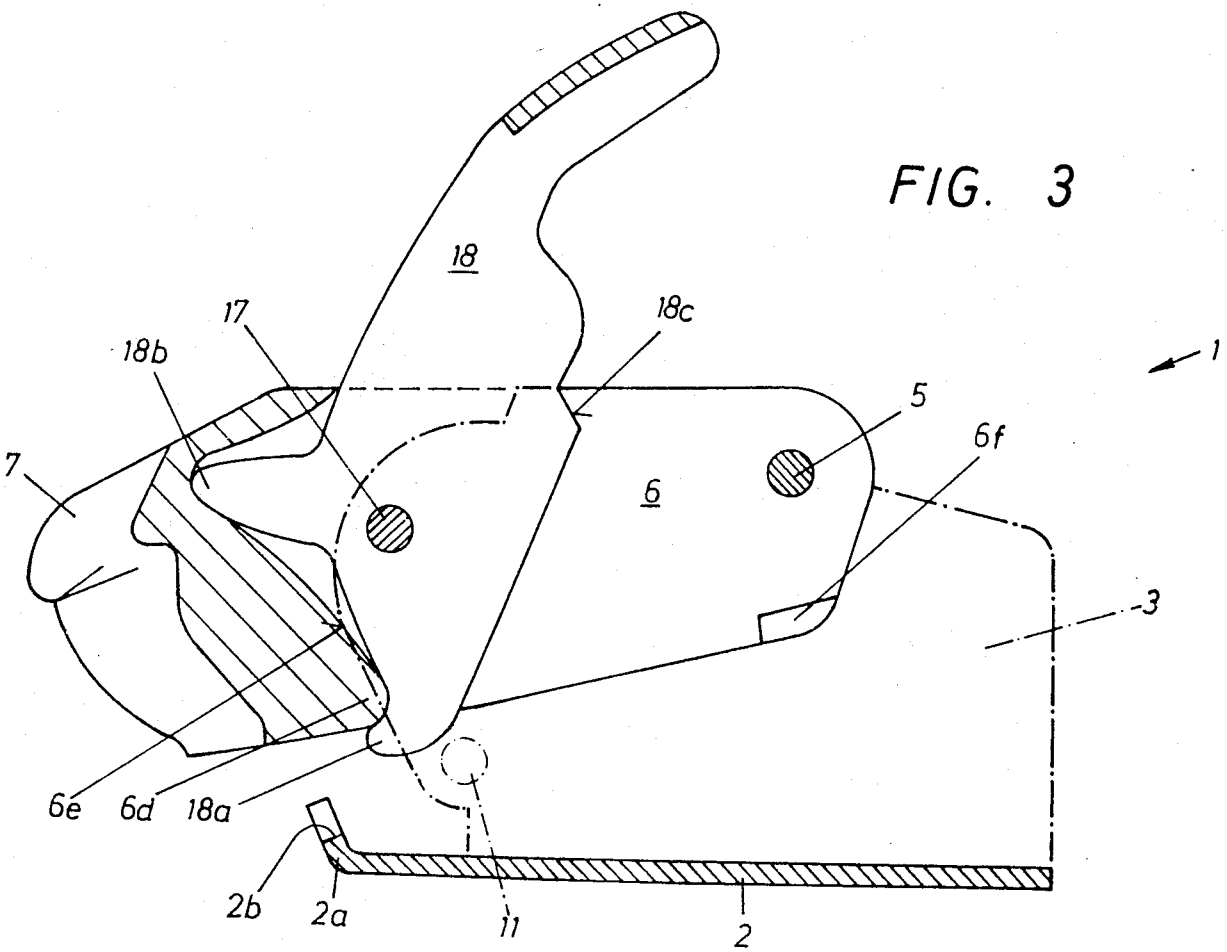
FIG. 3 is a sectional view taken along the line III—III in FIG. 2.
Figure 4:
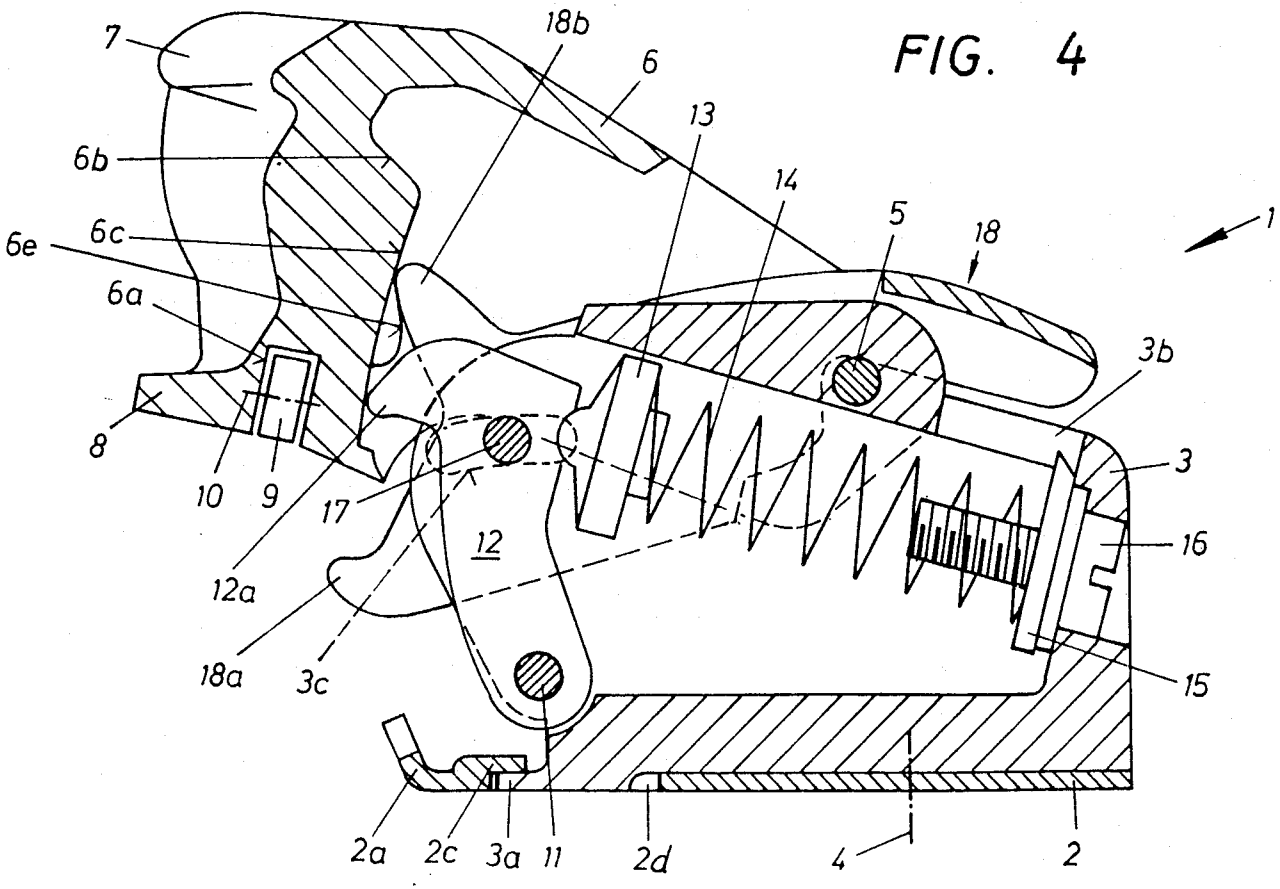
FIGS. 4 and 5 are sectional views which are respectively similar to FIGS. 1 and 3 but show the heel holder of FIG. 1 in a stepping-in position.
Figure 5:
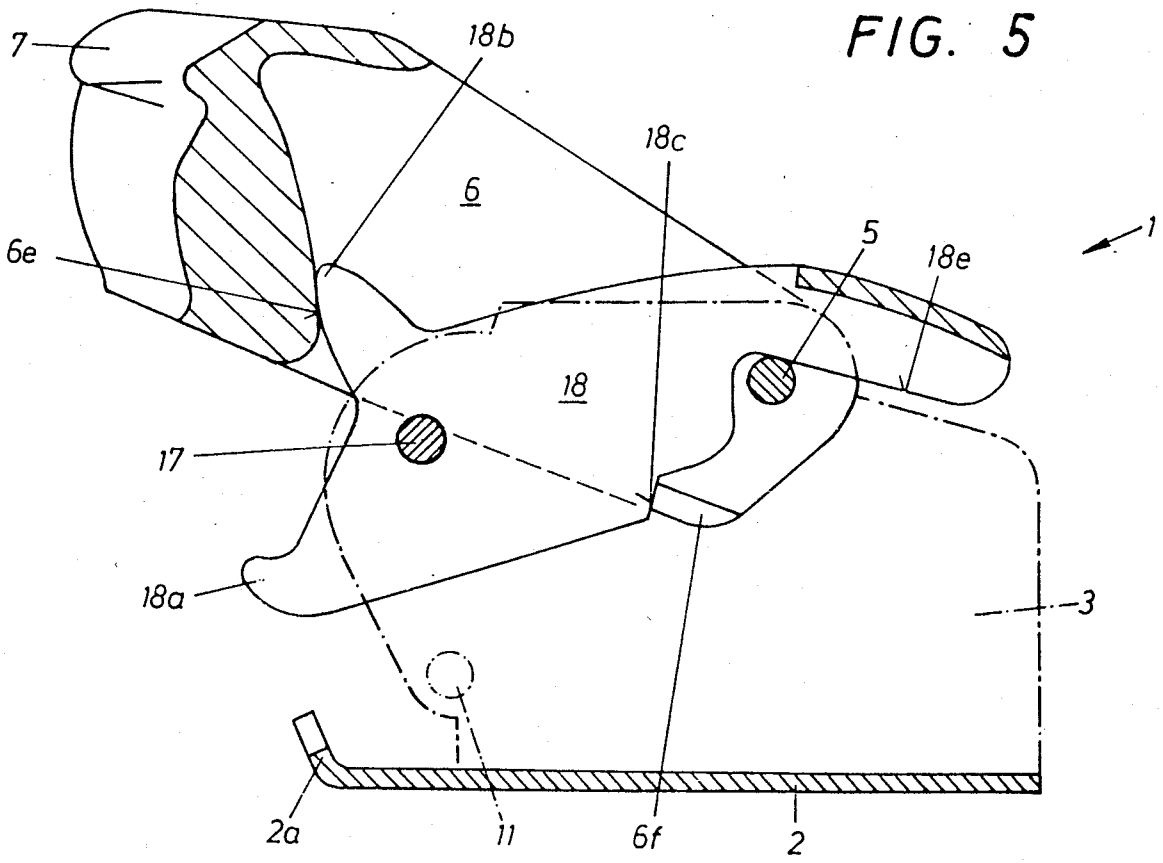

The heel holder in FIGS. 1–5 is identified in its entirety with reference numeral 1. It has a base plate 2 which, at an end thereof nearest the ski shoe, has a bent part 2*a* which carries a cam 2*b* (FIG. 3) for a lateral release. A housing-shaped bearing block 3 is supported for pivotal movement about a vertical axle 4 on the base plate 2. The bearing block 3 has a shoulder 3*a* arranged on its base so as to engage a slot 2*d* provided in the base plate 2, and shoulder 3*a* is prevented from upward movement perpendicular to the base plate by a bent part 2*c* provided on the base plate 2. The bearing block 3 is thus secured at its end adjacent the ski shoe against a lifting off from the base plate 2.

A transversely extending swivel axle 5 is arranged at the upper boundary of spaced side walls of the bearing block 3, which swivel axle 5 pivotally supports a binding housing 6 which, at its front end, carries a sole down-holding part 7 and a stepping spur 8. A downwardly open groove or recess 6*a*, which is rectangular in cross section, is provided in a front boundary wall of the binding housing 6, in which groove 6*a* a roller 9 is rotatably supported on an axle 10 and can engage the cam 2*b* on the bent part 2*a*. Furthermore, the front boundary wall carries on a side thereof which does not face the ski shoe a cam consisting of an upper portion 6*b* and a lower portion 6*c* which meet at the release point of the heel holder 1.

A second axle 11 is provided in a lower region of the sidewalls of the bearing block 3 and at an end thereof nearest the ski shoe, and the axle 11 pivotally supports a control lever 12. The control lever 12 has on its side which faces the ski shoe a nose 12*a* which slidably engages the cam portions 6*b* and 6*c*. On the side of the control lever 12 opposite the nose 12*a*, there is a recess or groove 12*b* which extends in a transverse direction and is segment-shaped or generally semicircular in cross section, in which groove a semicylindrical portion 13*a* of a pressure piece 13 is pivotally supported. The pressure piece 13 is biased by one end of a release spring 14, the other end of which is supported on a spring plate 15 which carries an indicator 15*a* for visually indicating the magnitude of the initial tension of the release spring, and the initial tension of the spring 14 can be adjusted by means of an adjusting screw 16 in a direction parallel to the axis of the release spring 14. The adjusting screw 16 is supported rotatably in but is held against axial movement relative to the bearing block 3. The spring plate indicator 15*a* is guided in a slot 3*b* in the bearing block 3 and in this manner secures the spring plate 15 against rotation. The indicator 15*a* moves thereby in the slot 3*b* of the bearing block 3 when screw 16 is rotated.

Between the nose 12 and the semicylindrical groove 12*b*, the control lever 12 carries a bolt 17 which extends in a transverse direction through arcuate slotted holes 3*c* provided in the sidewalls of the bearing block 3 so as to be concentric to the axle 11, and the bolt 17 has its ends projecting beyond the bearing block and pivotally supporting respective legs of a release lever 18 which is U-shaped in an end view. The end 18*a* (FIG. 3) of each leg of the release lever 18 is constructed approximately hook-shaped and, in the downhill skiing position of the heel holder 1, grips under a projection 6*d* provided on the binding housing 6. Furthermore, each leg of the release lever 18 also carries another projection 18*b* which, in the downhill skiing position, rests on a surface 6*e* of the projection 6*d* of the binding housing 6. Through this, the position of the release lever 18 in the skiing position of the heel holder 1 is clearly defined.

During movement of the heel holder 1 into its stepping-in position during a voluntary release, effected by exertion of a downward force onto the release lever 18, the binding housing 6 is first lifted by means of the projection 18*a* of the release lever 18, whereby the upper projections slide along the surfaces 6*e* of the projections 6*d* of the binding housing 6 until the release lever 18 engages the swivel axle 5 for the binding housing 6. A first stop 18*c* on the release lever 18, which is a transverse plane, comes at the same time into contact with an associated counterstop which is a shoulder 6*f* on the binding housing 6. The release lever 18 is in this manner held reliably on one hand by the swivel axle 5 and on the other hand by the shoulder 6*f* of the binding housing 6 in the stepping-in position of the heel holder 1, even when the initial tension of the release spring 14 is changed.

Figure 6:
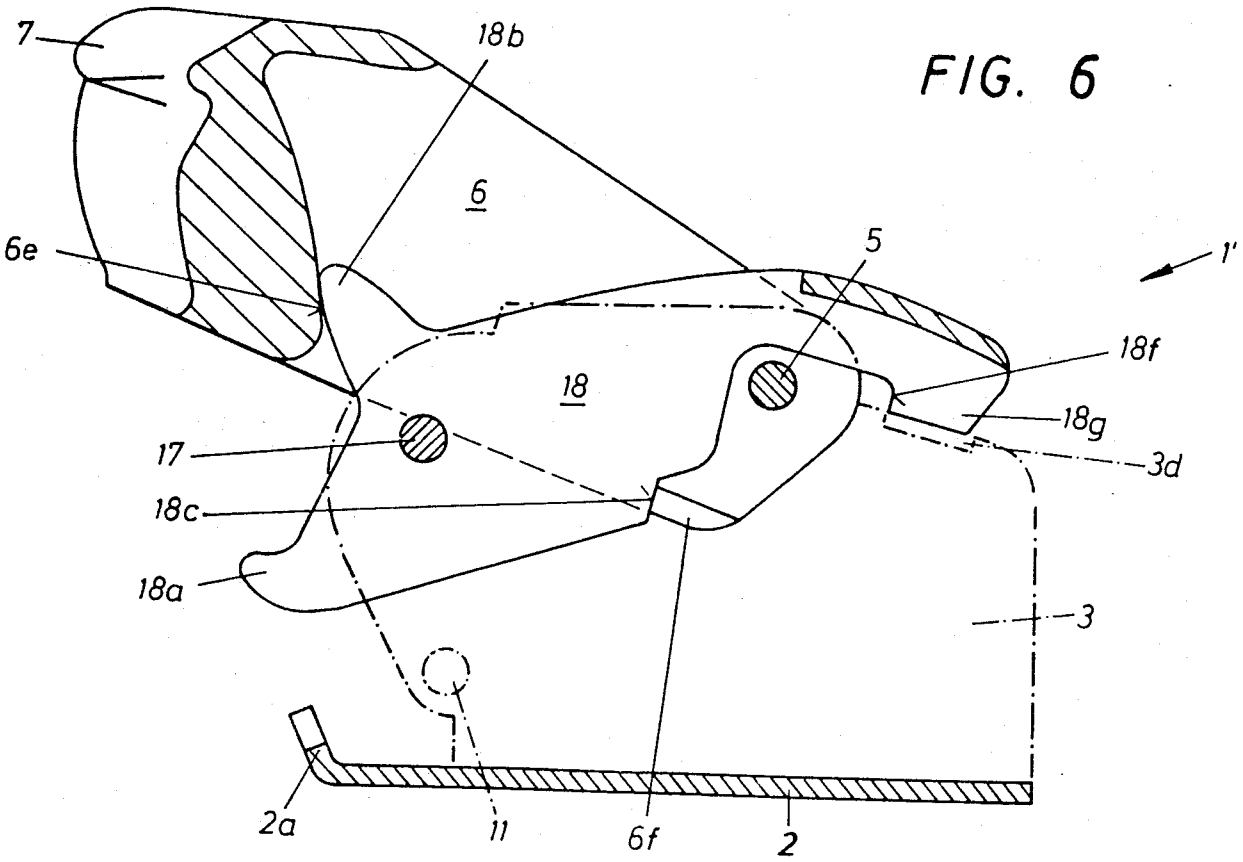
FIGS. 6–8 are sectional views similar to FIG. 5 which illustrate respective alternative embodiments of the heel holder of FIG. 1.

In the embodiment 1′ according to FIG. 6, the binding housing 6 also carries a shoulder 6*f* which is designed for engaging a transverse planar surface 18*c* on the release lever 18. The release lever 18 is, through this shoulder 6*f*, secured against movement in the stepping-in position of the heel holder 1′ against the force of the release spring. In order to define in this embodiment the angle of traverse of the release lever 18, the lever 18 carries a second stop 18*g* on its end which is opposite the two shoulders 18*a* and 18*b*, which second stop 18*g* is designed to engage a housing-like cover 3*d* of the bearing block 3. The swivel axle 5 itself is, in the stepping-in position of the heel holder 1′, disposed within a recess 18*f* which is provided in the release lever 18 and opens downwardly.

Figure 7:
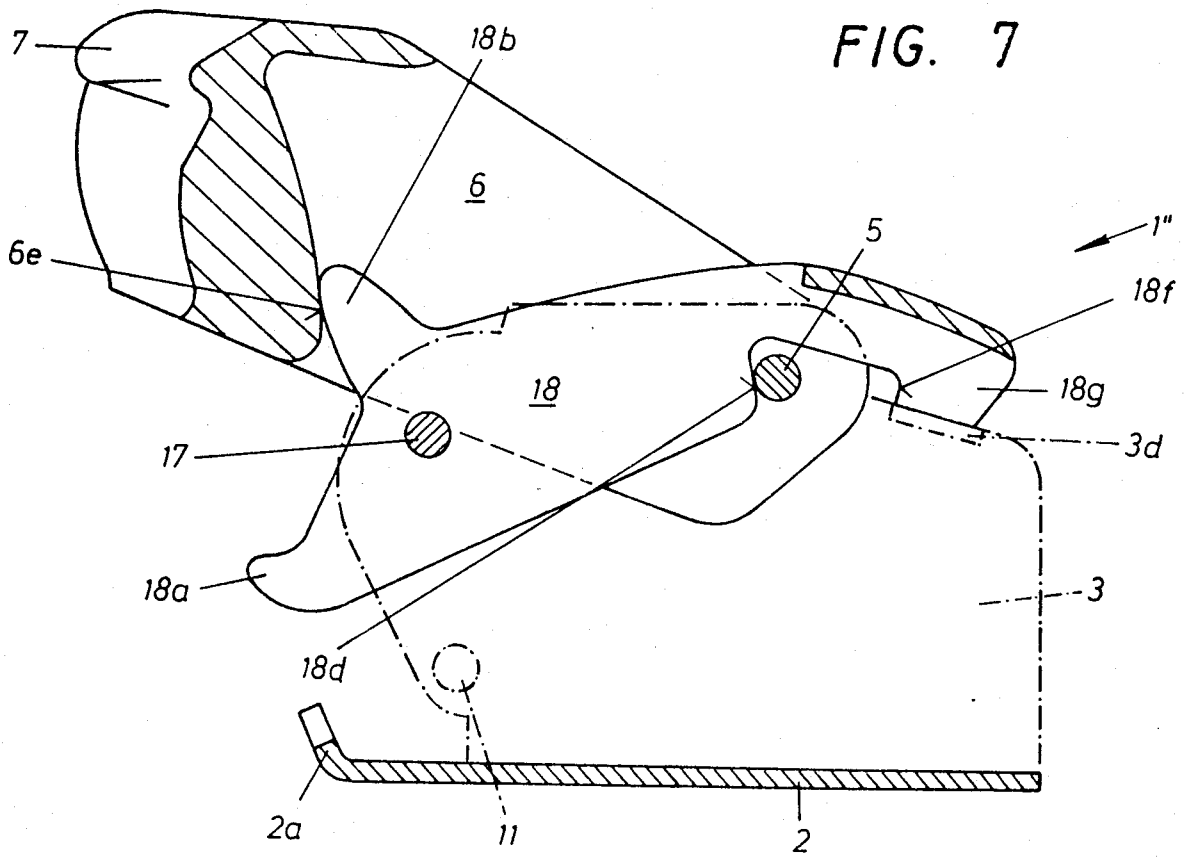

A heel holder 1″ which is a further embodiment of the invention is shown in FIG. 7. In contrast to the two preceding exemplary embodiments, no shoulder is provided on the binding housing in this embodiment. Rather, the first stop of the release lever is formed by a surface 18*d* on the wall of the recess 18*f* which is nearest the bolt 17. As in the preceding exemplary embodiment, a second stop 18*g* also serves to limit rotation of the release lever 18 and, in the stepping-in position of the heel holder 1″, engages the housinglike cover 3*d* of the bearing block 3.

Figure 8:
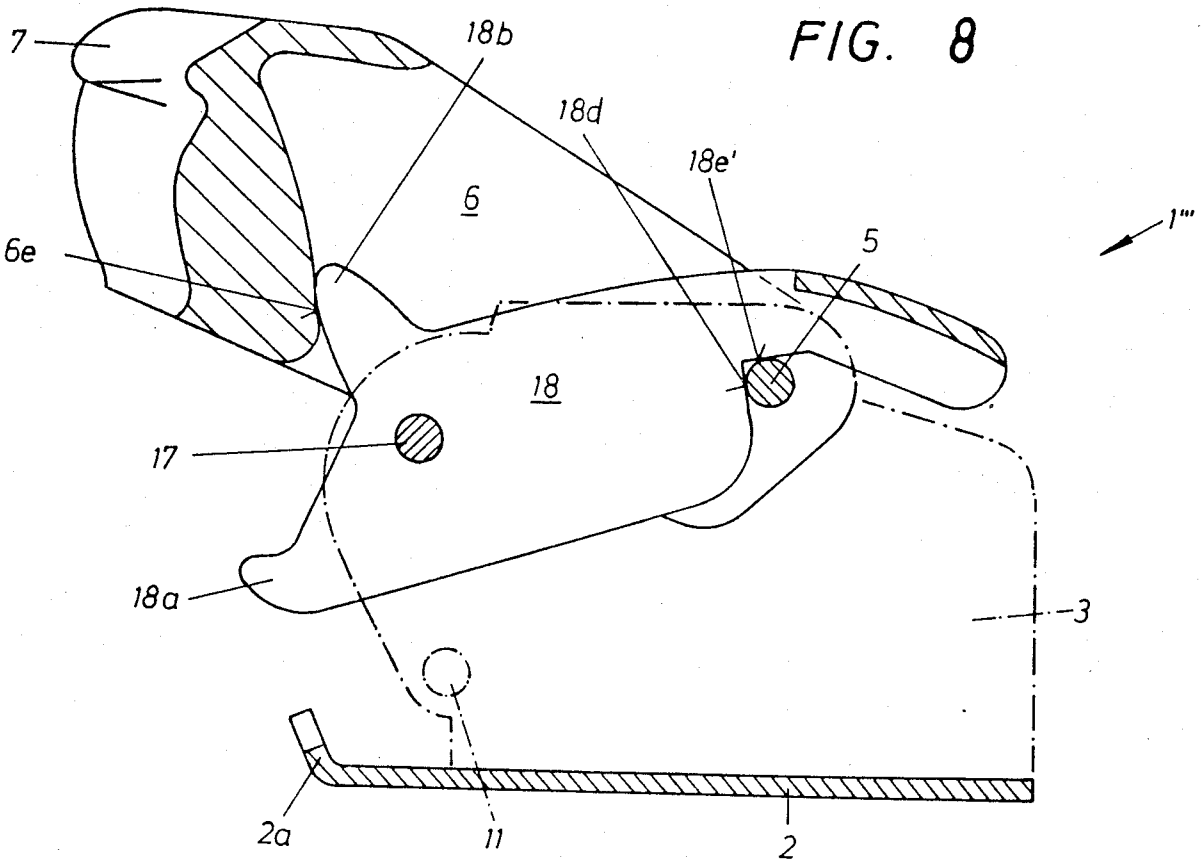

Finally, FIG. 8 shows a further heel holder 1‴ according to the invention in which a stop against movement of the release lever 18 and also a stop against pivoting thereof is formed by the swivel axle 5. The recess in the release lever 18 has for this purpose, aside from a transverse planar surface 18*d* which serves as the first stop and extends perpendicular to a connecting line between the swivel axle 5 and the bolt 17, a further surface 18*e*′ which serves as the second stop and is parallel to the mentioned connecting line.

The embodiments of the invention in which an exclusive property or privelege is claimed are defined as follows:

1. A heel holder, comprising: a base plate; a bearing block which is supported on the base plate, the bearing block having in an upper region thereof a swivel axle which pivotally supports a binding housing having down-holding means and a stepping spur, and the bearing block having in a lower region thereof a further swivel axle which pivotally supports a control lever which slidably engages a control element of the binding housing and is biased by a release spring which can be adjusted in its initial tension; and a two-arm release lever which is pivotally supported on a swivel axle provided on the control lever and which has on a load arm thereof an upper extension and a lower extension, the lowr extension being engageable with a projection on the binding housing and the upper extension serving as a stop for limiting upward swinging of the binding housing; wherein the swivel axle for the release lever extends through two arcuate slotted holes which are porvided in sidewalls of the bearing block and which have their centerpoints on a centerline of the swivel axle for the control lever; wherein the release lever carries a first stop which, in cooperation with a counterstop arranged on one of the binding housing and the bearing block, limits a releasing movement of the release lever; and wherein the release lever carries a second stop which, in an open position of the binding housing, engages the bearing block and thus limits the swinging movement of the release lever toward a releasing position thereof.

2. A heel holder according to claim 1, wherein the first stop on the release lever is a transverse planar surface, a line normal to which goes through a bolt which serves as the swivel axle for the release lever, and wherein the associated counterstop is formed by a shoulder provided on the binding housing.

3. A heel holder according to claim 1, wherein the first stop of the release lever lies in a plane tangential to a first bolt which serves as a counterstop and forms the swivel axle for the binding housing, wherein a line normal to said tangential plane goes through a second bolt which serves as the swivel axle for the release lever, and wherein the first stop is supported in the open position of the release lever on the first bolt.

4. A heel holder according to claim 1, wherein the bearing block includes a housinglike cover and wherein, when the binding housing is in its open position, the second stop engages the housinglike cover of the bearing block.

5. A heel holder according to claim 1, wherein when the binding housing is in its open position, the second stop engages a bolt which serves as the swivel axle of the binding housing.

6. A heel holder according to claim 1, wherein when the binding housing is in its open position, the first stop and the second stop each engage a bolt which forms the swivel axle of the binding housing.

* * * * *